US009909417B2

(12) United States Patent
Hall et al.

(10) Patent No.: US 9,909,417 B2
(45) Date of Patent: Mar. 6, 2018

(54) ANGLED DEGRADATION PICK

(71) Applicant: Novatek IP, LLC, Provo, UT (US)

(72) Inventors: David R. Hall, Provo, UT (US); Ronald B. Crockett, Spring City, UT (US); Dwain Norris, Spanish Fork, UT (US); Gary Condon, Canonsburg, PA (US); Gary Peterson, Salem, UT (US); Jeffrey Crockett, Spanish Fork, UT (US)

(73) Assignee: NOVATEK IP, LLC, Provo, UT (US)

( * ) Notice: Subject to any disclaimer, the term of this patent is extended or adjusted under 35 U.S.C. 154(b) by 0 days.

(21) Appl. No.: 14/707,475

(22) Filed: May 8, 2015

(65) Prior Publication Data

US 2016/0024917 A1 Jan. 28, 2016

Related U.S. Application Data

(60) Provisional application No. 62/028,742, filed on Jul. 24, 2014.

(51) Int. Cl.

| | |
|---|---|
| ***E21C 35/18*** | (2006.01) |
| ***E21C 35/183*** | (2006.01) |
| ***E21C 35/19*** | (2006.01) |
| ***E21C 35/197*** | (2006.01) |

(52) U.S. Cl.

CPC ..... *E21C 35/19* (2013.01); *E21C 35/18* (2013.01); *E21C 35/183* (2013.01); *E21C 35/197* (2013.01); *E21C 2035/1803* (2013.01); *E21C 2035/1806* (2013.01); *E21C 2035/1816* (2013.01)

(58) Field of Classification Search

CPC ..... E21C 35/18; E21C 2035/1803; E21C 35/183; E01C 23/127

See application file for complete search history.

(56) References Cited

U.S. PATENT DOCUMENTS

| | | | | |
|---|---|---|---|---|
| 3,830,321 A | | 8/1974 | McKenry | |
| 3,841,709 A | * | 10/1974 | Kniff | 299/101 |
| 4,346,934 A | * | 8/1982 | College | E21C 35/197 175/354 |
| 4,647,111 A | * | 3/1987 | Bronder et al. | 299/113 |

(Continued)

OTHER PUBLICATIONS

International Search Report issued in International Patent Application No. PCT/US2015/029903 dated Aug. 12, 2015, 7 pages.

(Continued)

*Primary Examiner* — David J Bagnell
*Assistant Examiner* — Michael A Goodwin

(57) ABSTRACT

A degradation pick of the type used in such fields as road milling, mining, and trenching to engage and degrade tough materials such as asphalt, concrete, and rock may comprise a body attached at one end to a substantially cylindrical shaft. A hardened tip may also be attached to the body opposite the shaft. The hardened tip may comprise an axis offset from a central axis of the shaft. Such a degradation pick may be secured to an exterior of a rotatable drum or continuous chain so as to be repeatedly brought into contact with a surface of a material to be degraded. The body may comprise a protruding spine adjacent the hardened tip and opposite a direction of travel of the hardened tip when transported by a rotating drum or continuous chain.

20 Claims, 14 Drawing Sheets

(56) References Cited

U.S. PATENT DOCUMENTS

| | | | | |
|---|---|---|---|---|
| 4,655,508 | A * | 4/1987 | Tomlinson | E21B 10/567 175/413 |
| 4,678,237 | A * | 7/1987 | Collin | E21B 10/567 299/112 R |
| 6,173,798 | B1 * | 1/2001 | Bryant et al. | 175/426 |
| 6,270,165 | B1 * | 8/2001 | Peay | E21C 35/183 299/111 |
| 6,918,636 | B2 | 7/2005 | Dawood | |
| 7,396,086 | B1 | 7/2008 | Hall | |
| 8,136,887 | B2 | 3/2012 | Hall et al. | |
| 8,789,894 | B2 | 7/2014 | Lucek | |
| 8,998,346 | B2 | 4/2015 | Hall | |
| 2002/0109395 | A1 * | 8/2002 | Sollami | B28D 1/188 299/106 |
| 2006/0255649 | A1 * | 11/2006 | Dawood | 299/87.1 |
| 2010/0194176 | A1 | 8/2010 | Lucek et al. | |
| 2010/0263939 | A1 * | 10/2010 | Hall et al. | 175/430 |
| 2013/0009446 | A1 * | 1/2013 | Hall | B28D 1/188 299/105 |
| 2014/0015305 | A1 | 1/2014 | Jonker et al. | |
| 2014/0368022 | A1 * | 12/2014 | Torres Delgado et al. | 299/105 |

OTHER PUBLICATIONS

Written Opinion issued in International Patent Application No. PCT/US2015/029903 dated Aug. 12, 2015, 8 pages.

International Preliminary Report on Patentability issued in International Patent Application No. PCT/US2015/029903 dated Jan. 24, 2017, 9 pages.

* cited by examiner

ANGLED DEGRADATION PICK

CROSS REFERENCE TO RELATED APPLICATIONS

This patent application claims priority to U.S. Provisional Pat. App. No. 62/028,742 filed Jul. 24, 2014, which is incorporated herein by reference for all that it contains.

BACKGROUND OF THE INVENTION

Degradation picks are known to be used in such fields as road milling, mining, and trenching to engage and degrade tough materials such as asphalt, concrete, and rock. In use, such degradation picks may be secured to an exterior of a rotatable drum or continuous chain so as to be repeatedly brought into contact with a surface of a material to be degraded.

Degradation picks are known to take several forms. One form of degradation pick, as described in U.S. Pat. No. 7,396,086 to Hall, et al., comprises a shank attached to a base of a steel body. A cemented metal carbide core may be press fit into the steel body opposite the shank. An impact tip, comprising a carbide substrate and a diamond material bonded to the substrate, may be bonded to the core opposite the shank. Additionally, the shank, carbide core and diamond material may be generally coaxial.

While this known arrangement may prove sufficient in some applications, it may also expose degradation picks to side impact forces which they may not be constructed to withstand. Specifically, impact testing has shown that axially symmetrical degradation picks experiencing impact forces at an angle greater than 35 degrees off axis fracture significantly more often than those experiencing axial impact forces.

Some forms of degradation picks, such as those commonly known as radial tools, are designed specifically to degrade a formation in a manner that the degradation pick experiences impact forces from an angle. For example, U.S. Pat. No. 8,789,894 to Lucek et al., describes a non-rotating mining cutter pick comprising a shank portion with a non-circular cross-section, a head portion including a tip region distal from the shank portion, and a cutting insert mounted at a front end of the tip region. The cutting insert is typically positioned on a forward working portion to cut into a mineral formation during operation. While the non-circular cross-section may restrict the mining cutter pick from rotating, it may only be used at one angle, which is the angle of the block used to support the radial tool.

Accordingly, a need exists in the art for a degradation pick assembly that allows a hardened tip to experience impact forces at an ideal angle while being able to be inserted into a block at multiple angles.

BRIEF SUMMARY OF THE INVENTION

A degradation pick of the type used in such fields as road milling, mining, and trenching to engage and degrade tough materials such as asphalt, concrete, and rock may comprise a body attached at one end to a substantially cylindrical shaft. A hardened tip may also be attached to the body opposite the shaft. The hardened tip may comprise an axis offset from a central axis of the shaft. Such a degradation pick may be secured by its shaft to an exterior of a rotatable drum or continuous chain so as to be repeatedly brought into contact with a surface of a material to be degraded.

The body of the degradation pick may further comprise a protruding spine adjacent the hardened tip and opposite a direction of travel of the hardened tip when transported by a rotating drum or continuous chain. The protruding spine may be substantially complementary to a path traveled by a distal end of the hardened tip. In some embodiments, the shaft of the degradation pick may be rotationally positioned relative to a rotatable drum or continuous chain such that the protruding spine pushes aggregate perpendicular to a plane in which the hardened tip travels.

In various embodiments, an angle between the axis of the hardened tip and the central axis of the shaft may be between 7 and 25 degrees and/or an angle between the axis of the hardened tip and a path traveled by the distal end of the hardened tip may be between 25 and 43 degrees.

The shaft of the degradation pick may be rotationally positioned such that the axis of the hardened tip is slanted, in relation to the central axis of the shaft, toward a direction of travel of the hardened tip. Further, the shaft may comprise a locking mechanism to fix the shaft within a bore at such a position. In various embodiments, the substantially cylindrical shaft may comprise a cross section of circular or elliptical geometry.

The body of the degradation pick may comprise a first dimension parallel to a plane in which the hardened tip travels larger than a second dimension perpendicular to the plane. The body may also comprise hard facing or hard materials secured to the body adjacent the hardened tip in the direction of travel. In various embodiments, such hard facing or hard materials may wrap over a surface of the body facing the direction of travel.

The hardened tip may comprise an aspect ratio between 0.86 and 1 designated as a maximum width of the hardened tip divided by a length from the distal end of the hardened tip to a point where the hardened tip makes contact with the body of the degradation pick. In various embodiments, the hardened tip may comprise a superhard material comprising a substantially conical shape or a wedge shape formed from two surfaces meeting at a ridge at the distal end of the hardened tip. In embodiments where the wedge shape is employed, the shaft of the degradation pick may be rotationally positioned such that the ridge of the wedge shape is parallel to a plane in which the hardened tip travels. The axis of the hardened tip may be offset from the central axis of the shaft such that one end of the ridge extends beyond a remainder of the hardened tip in a direction of travel. Additionally, the two surfaces forming the wedge shape may be positioned such that an angle at the ridge where the two surfaces meet is wider at one end and narrower at another end. In some embodiments, a first end of the ridge of the wedge shape may be disposed at a greater distance from the body than a second end of the ridge. In such embodiments, the shaft of the degradation pick may be rotationally positioned such that the first end of the ridge is facing the direction of travel.

DETAILED DESCRIPTION OF THE DRAWINGS

Figure 1:
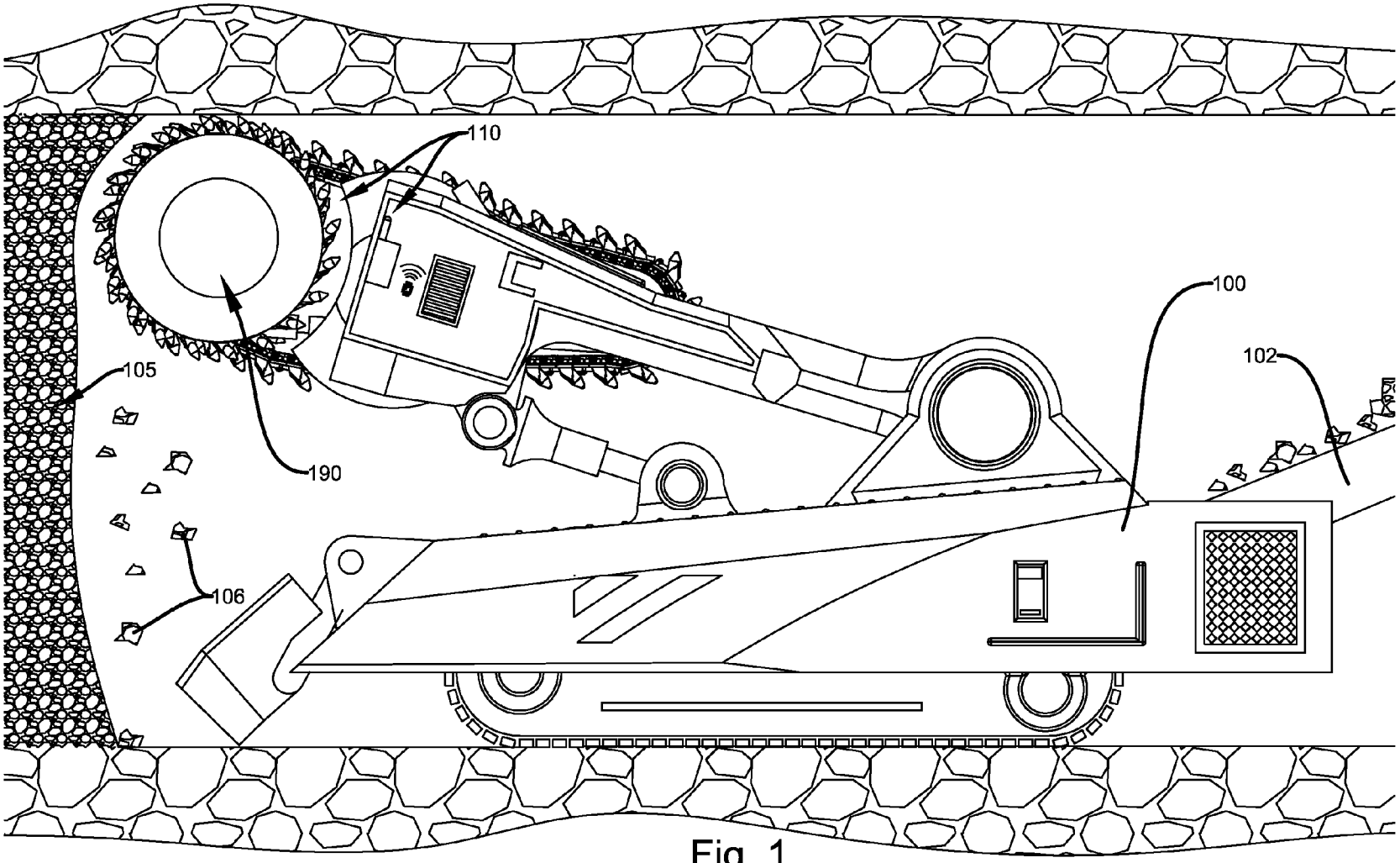
FIG. 1 is an orthogonal view of an embodiment of a formation degradation machine.

FIG. 1 shows an embodiment of a formation degradation machine 100 comprising a plurality of degradation picks 110 secured to an exterior of a rotatable drum 190. Rotation of the rotatable drum 190 by the formation degradation machine 100 may bring the degradation picks 110 repeatedly into contact with a surface of a material 105. This repeated engagement of the degradation picks 110 to the material 105 may degrade the material 105 causing it to break up into aggregate 106. In the present embodiment, the formation degradation machine 100 is located in an underground mine and the material 105 to be degraded, coal for example, is contained in a wall of the mine. Once a portion of the material 105 is degraded into aggregate 106 it may be captured by a conveyor 102 and removed for processing. While the embodiment shown depicts a rotatable drum 190 on a formation degradation machine 100 as part of a mining operation, it should be understood that the present invention may also be used in conjunction with rotatable drums or continuous chains being used in mining, road milling, trenching or other operations where it is desirable to degrade tough materials such as asphalt, concrete or rock.

Figure 2:
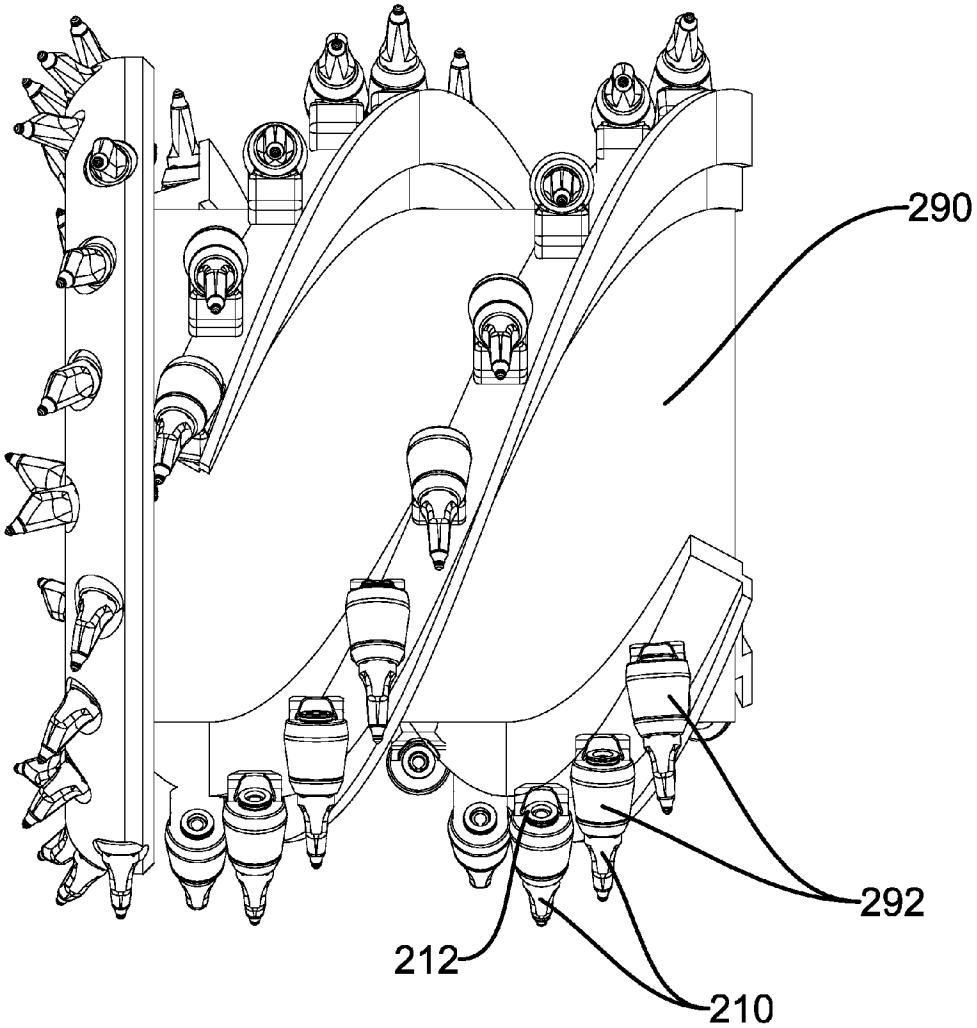
FIG. 2 is an orthogonal view of an embodiment of rotatable drum comprising a plurality of degradation picks secured thereto.

FIG. 2 shows an embodiment of a rotatable drum 290 as seen by a material to be degraded. A plurality of blocks 292 may be disposed around an exterior of the rotatable drum 290. Each of the blocks 292 may have a bore disposed therein to receive a shaft 212 from each of a plurality of degradation picks 210. Rotation of the rotatable drum 290 may cause the degradation picks 210 to engage and degrade a material. The blocks 292 may be positioned around the exterior of the rotatable drum 290 to optimize degradation and/or transport aggregate away from the material being degraded.

Figure 3:
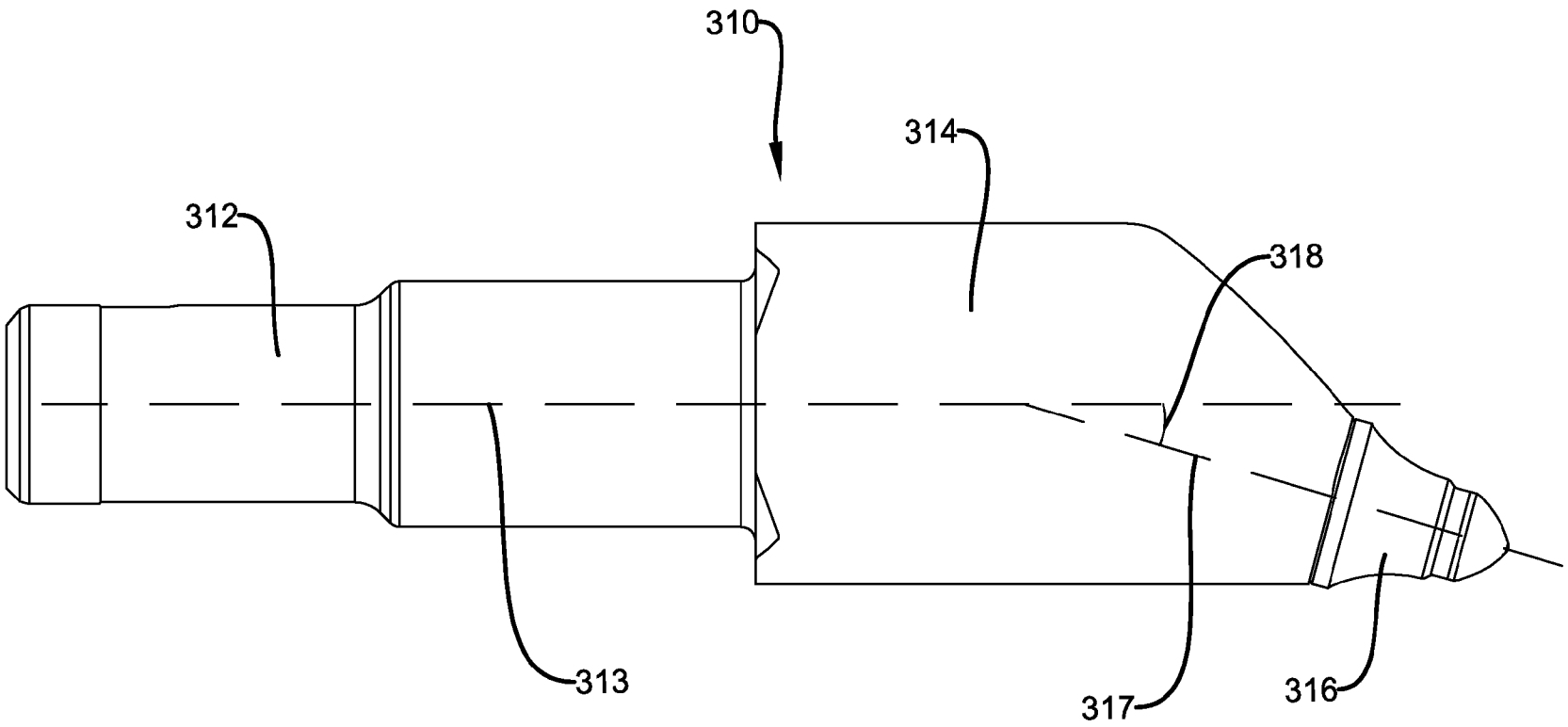
FIG. 3 is an orthogonal view of an embodiment of a degradation pick.

FIG. 3 shows an embodiment of a degradation pick 310 comprising a body 314 attached to one end of a substantially cylindrical shaft 312 with a hardened tip 316 attached to the body 314 opposite the shaft 312. The hardened tip 316 may comprise an axis 317 there through offset from a central axis 313 of the shaft 312. In the embodiment shown, an angle 318 between the axis 317 of the hardened tip 316 and the central axis 313 of the shaft 312 is between 7 and 25 degrees.

Figure 4:
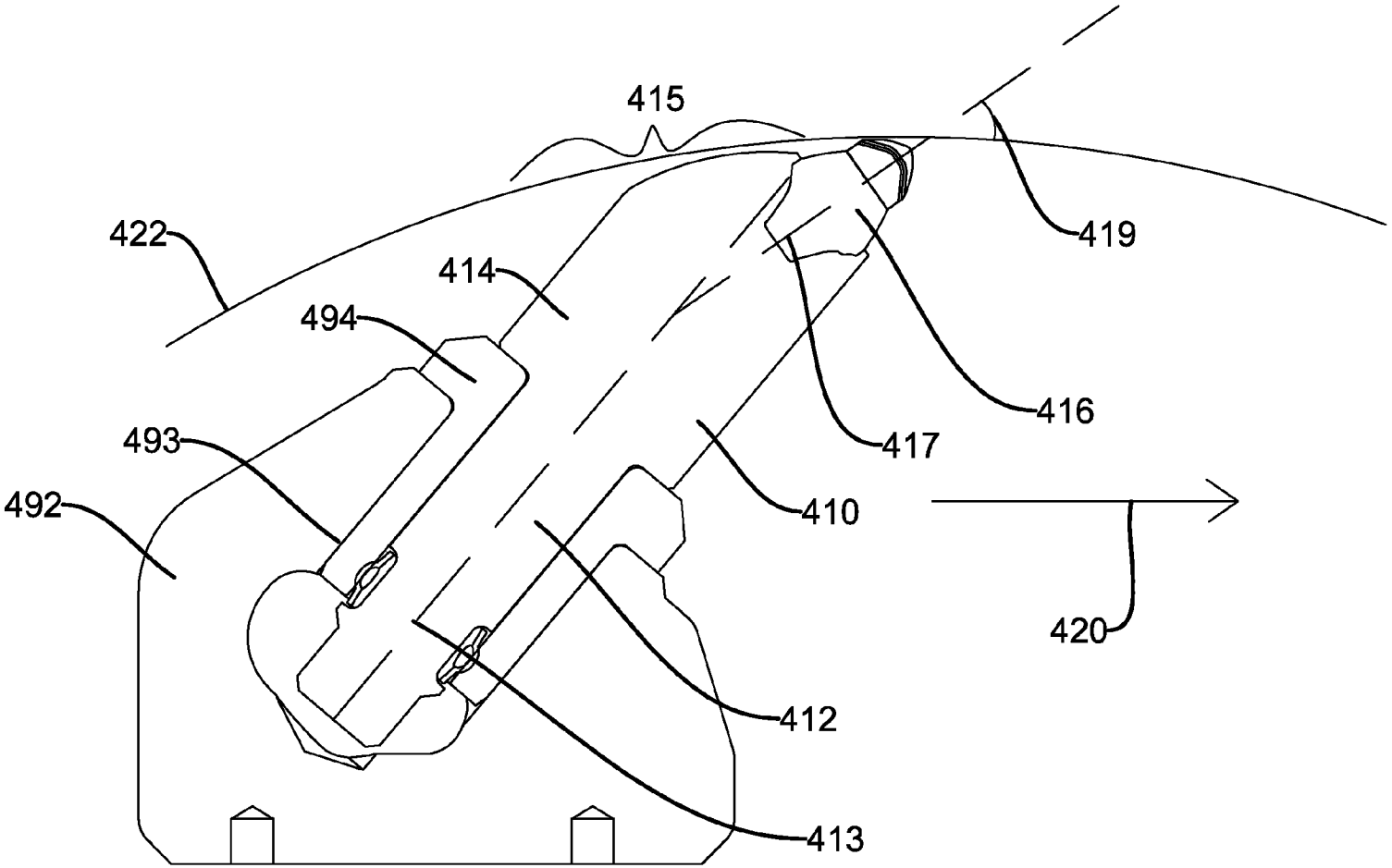
FIG. 4 is a longitudinal section view of an embodiment of a degradation pick secured within a block.

FIG. 4 shows an embodiment of a degradation pick 410 secured within a block 492. A shaft 412 of the degradation pick 410 may be inserted directly into a bore 493 of the block 492 or, as shown in the present embodiment, the shaft 412 may be inserted into a sleeve 494 that is positioned within the bore 493. It is believed that the sleeve 494 may protect the block 492 from wear in various circumstances and/or adjust for varying sizes of shafts. As described previously, the block 492 may be disposed on a rotatable drum or continuous chain that may drive the block 492 through a repetitive range of motion. As the block 492 is driven, the degradation pick 410 may be brought into repeated engagement with a surface to be degraded. The shaft 412 of the degradation pick 410 may be rotationally positioned within the bore 493 such that an axis 417 of a hardened tip 416 of the degradation pick 410 is slanted, in relation to a central axis 413 of the shaft 412, toward a direction of travel 420 of the hardened tip 416 when transported by a rotating drum or continuous chain. This slant may be such that an angle 419 between the axis 417 of the hardened tip 416 and a path 422 traveled by a distal end of the hardened tip 416 is between 25 and 43 degrees.

The embodiment shown in FIG. 4 also comprises a spine 415 protruding from a body 414 of the degradation pick 410 adjacent the hardened tip 416 and opposite a direction of travel 420 thereof. An outer surface of the protruding spine 415 may be substantially complementary to the path 422 traveled by the distal end of the hardened tip 416.

Figure 5A:
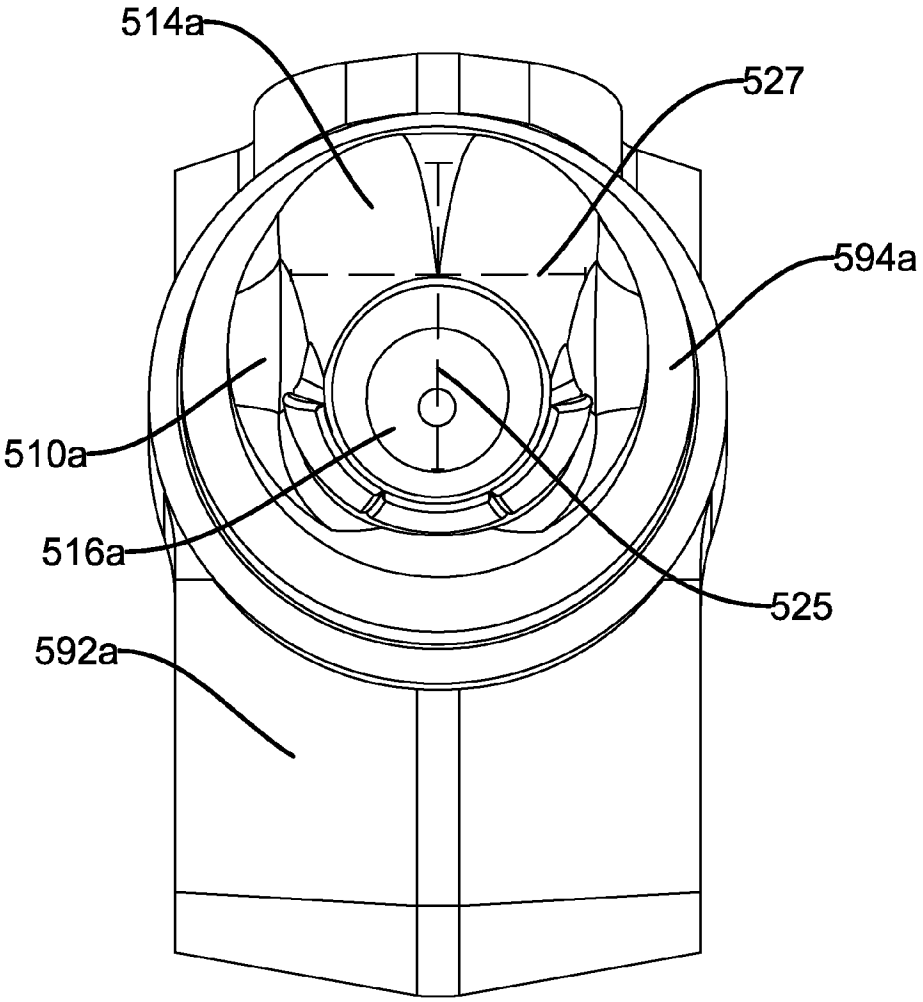
FIGS. 5*a* and 5*b* are top views of various embodiments of degradation picks secured within blocks.
Figure 5B:
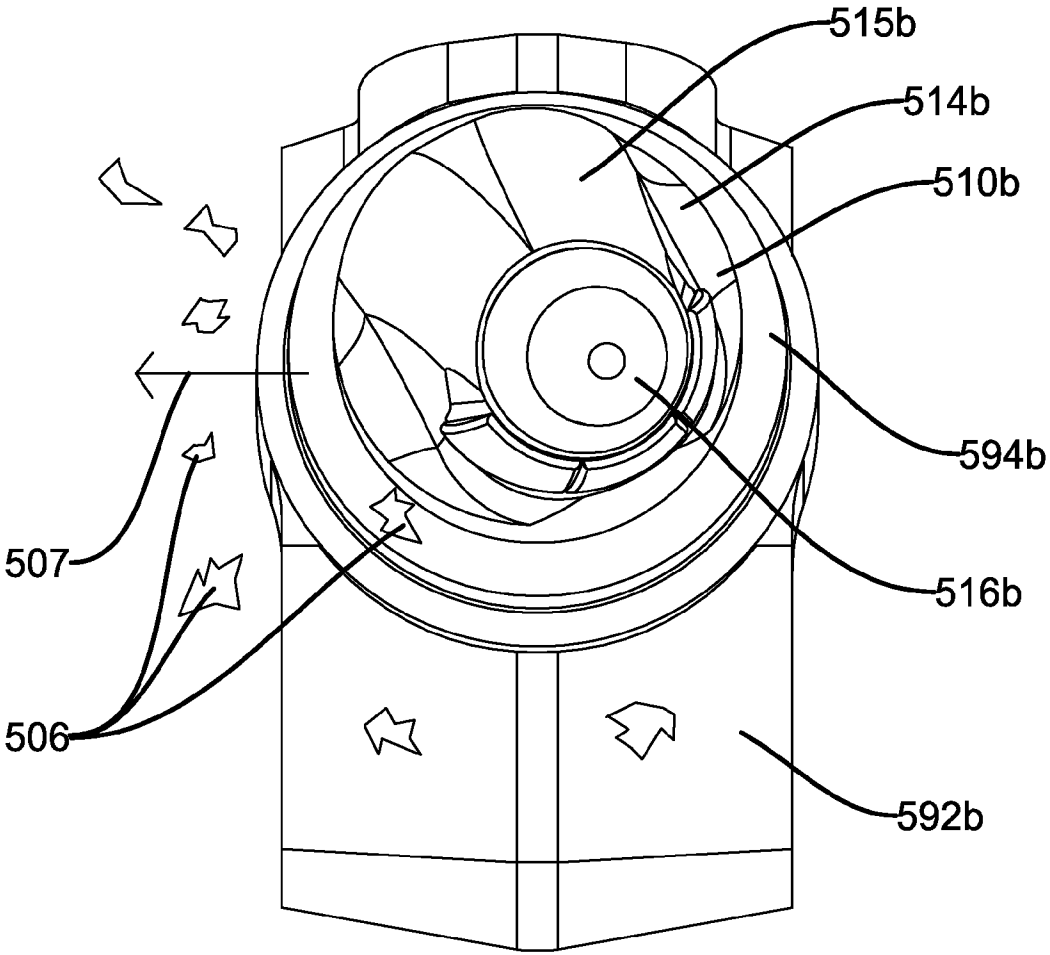

FIGS. 5*a* and 5*b* show different embodiments of degradation picks 510*a*, 510*b* secured within blocks 592*a*, 592*b*. In the embodiments shown, the degradation picks 510*a*, 510*b* are secured within the blocks 592*a*, 592*b* respectively via shafts of the degradation picks 510*a*, 510*b* being inserted into sleeves 594*a*, 594*b* positioned within bores within the blocks 592*a*, 592*b*. A body 514*a* of the degradation pick 510*a* may comprise a first dimension 525 parallel to a plane in which a hardened tip 516*a* of the degradation pick 510*a* travels when transported by a rotating drum or continuous chain larger than a second dimension 527 perpendicular to the plane in which the hardened tip 516*a* travels. Additionally, the shaft of the degradation pick 510*b* may be rotationally positioned such that a protruding spine 515*b* of a body 514*b* of the degradation pick 510*b* may push aggregate 506 perpendicular 507 to a plane in which a hardened tip 516*b* travels when transported by a rotating drum or continuous chain.

Figure 6:
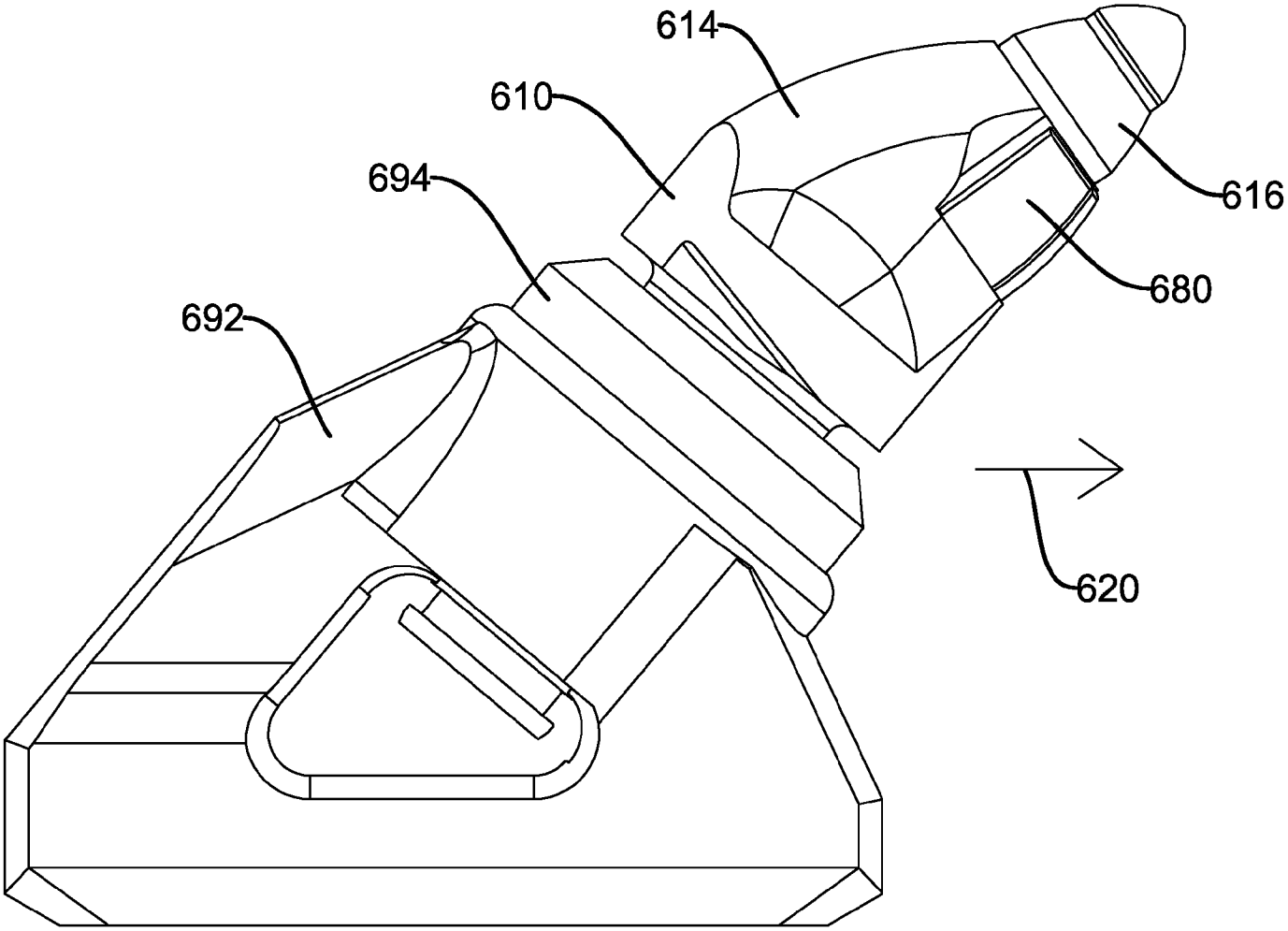
FIG. 6 is a side view of an embodiment of a degradation pick comprising hard materials secured thereto and secured within a block.

FIG. 6 shows an embodiment of a degradation pick 610 secured within a block 692 by means of a sleeve 694. The degradation pick 610 may comprise hard facing or hard materials secured to a body 614 of the degradation pick 610. In the embodiment shown, hard materials 680 are secured to the body 614 adjacent a hardened tip 616 in a direction of travel 620 of the hardened tip 616 when transported by a rotating drum or continuous chain.

Figure 7:
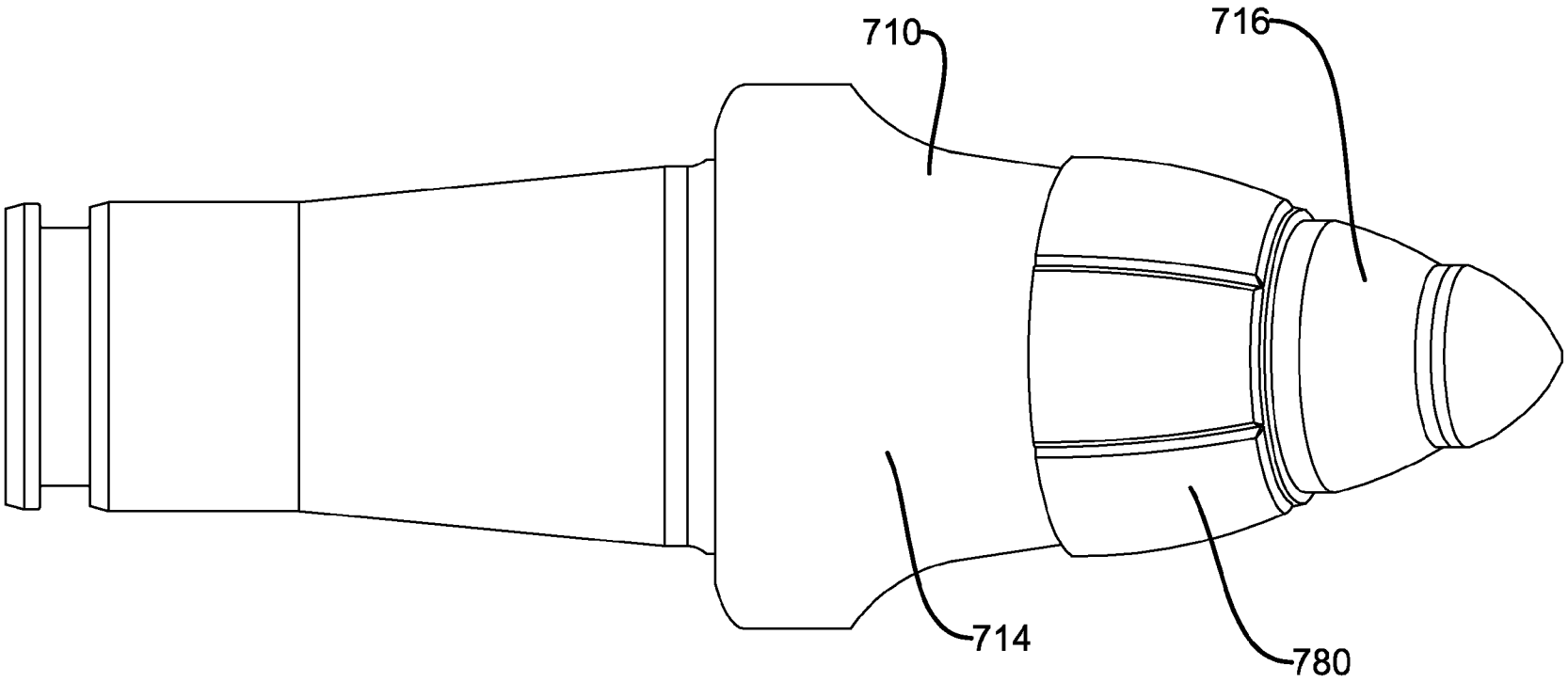
FIG. 7 is a front view of another embodiment of a degradation pick comprising hard materials secured thereto.

FIG. 7 shows another embodiment of a degradation pick 710 comprising hard materials 780 secured to a body 714 thereof. As seen in this embodiment, the hard materials 780 may wrap over a surface of the body 714 facing a direction of travel of a hardened tip 716 of the degradation pick 710.

Figure 8:
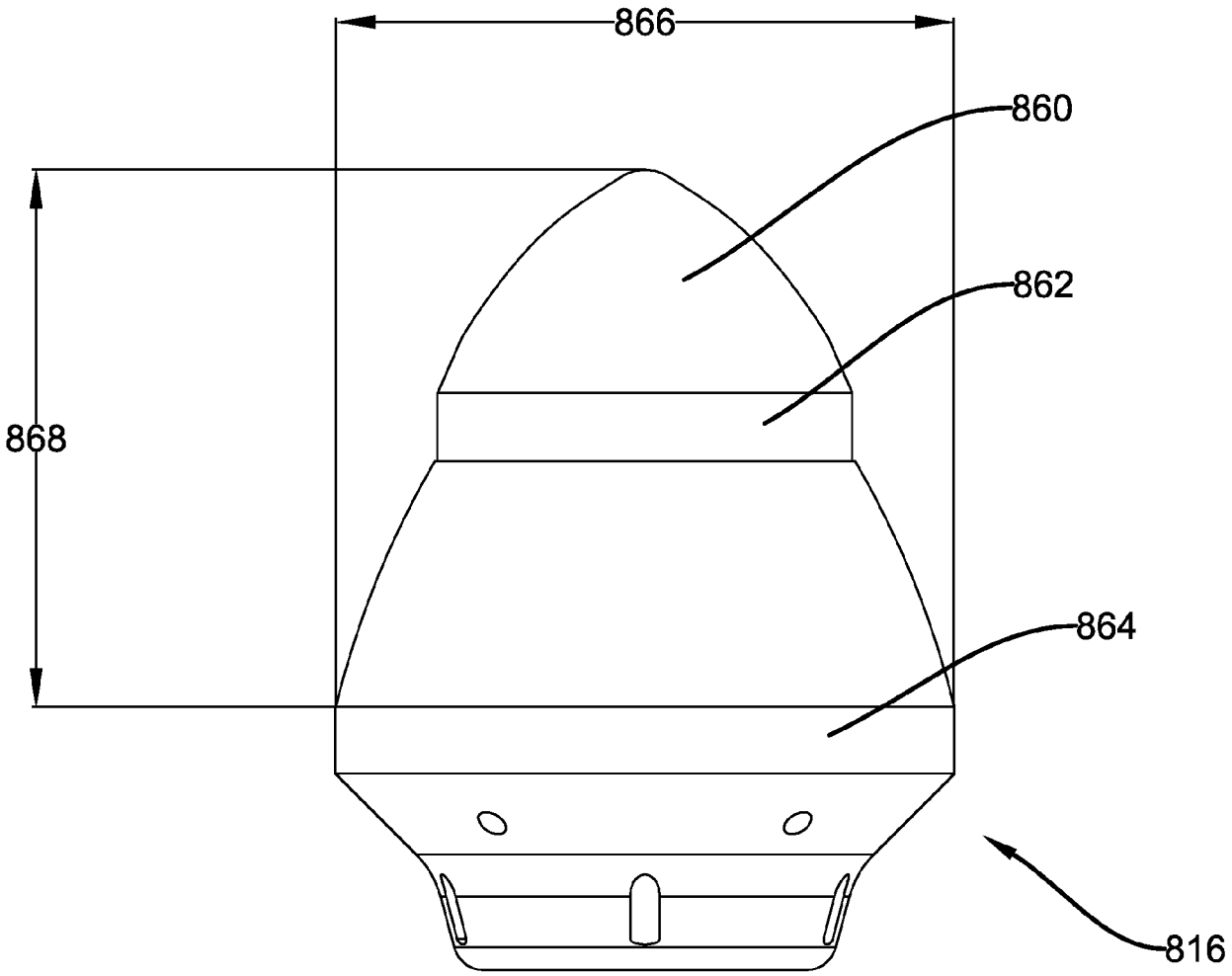
FIG. 8 is a side view of an embodiment of a hardened tip.

FIG. 8 shows an embodiment of a hardened tip 816. While a variety of materials of sufficient hardness to degrade tough materials such as asphalt, concrete, and rock may be used to form a hardened tip, in the embodiment shown the hardened tip 816 comprises a superhard material 860, such as polycrystalline diamond, sintered to a carbide substrate 862. The superhard material 860 may be sintered to the carbide substrate 862 through a high-pressure high-temperature process such as those known in the art. The carbide substrate 862 may be brazed to a carbide bolster 864. An aspect ratio of the hardened tip 816 may be designated as a maximum width 866 of the hardened tip 816 divided by a length 868 from a distal end of the hardened tip 816 to a point where the hardened tip 816 makes contact with a body of a degradation pick (not shown). It is believed that an aspect ratio between 0.86 and 1 may provide sufficient protection to a degradation pick when formed in the manner disclosed herein.

Figure 9:
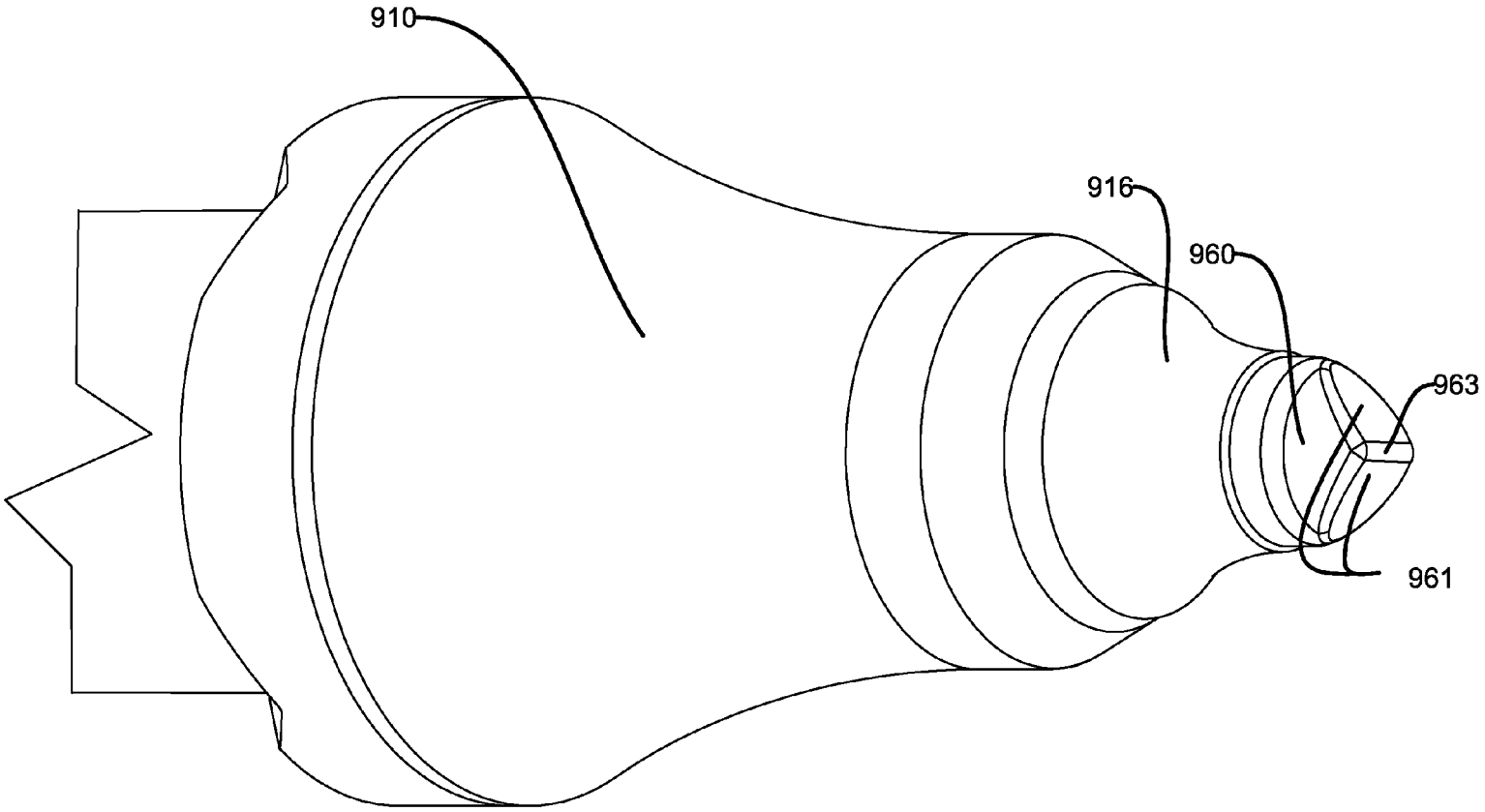
FIG. 9 is a front view of a portion of an embodiment of a degradation pick comprising a wedge shaped superhard material.

The embodiment of the hardened tip 816 shown in FIG. 8 comprises a superhard material 860 with a substantially conical shape. However, in various other embodiments, a hardened tip of a degradation pick may comprise other geometries that may assist in degradation of a material. For example, FIG. 9 shows an embodiment of a degradation pick 910 comprising a hardened tip 916 with a superhard material 960 forming a portion thereof. In the view shown in FIG. 9, when transported by a rotating drum or continuous chain, the hardened tip 916 may travel toward the viewer. The superhard material 960 may comprise a wedge shape formed from two surfaces 961 meeting at a ridge 963 at a distal end of the hardened tip 916. A shaft of the degradation pick 910 may be rotationally positioned such that the ridge 963 of the wedge shape is parallel to a plane in which the hardened tip 916 travels when transported by a rotating drum or continuous chain. Further, in some embodiments such as the one shown, the two surfaces 961 forming the wedge shape may be positioned such that an angle at the ridge 963 where the two surfaces 961 meet is wider at one end (closest to the viewer in this embodiment) and narrower at another end (furthest from the viewer in this embodiment).

Figure 10:
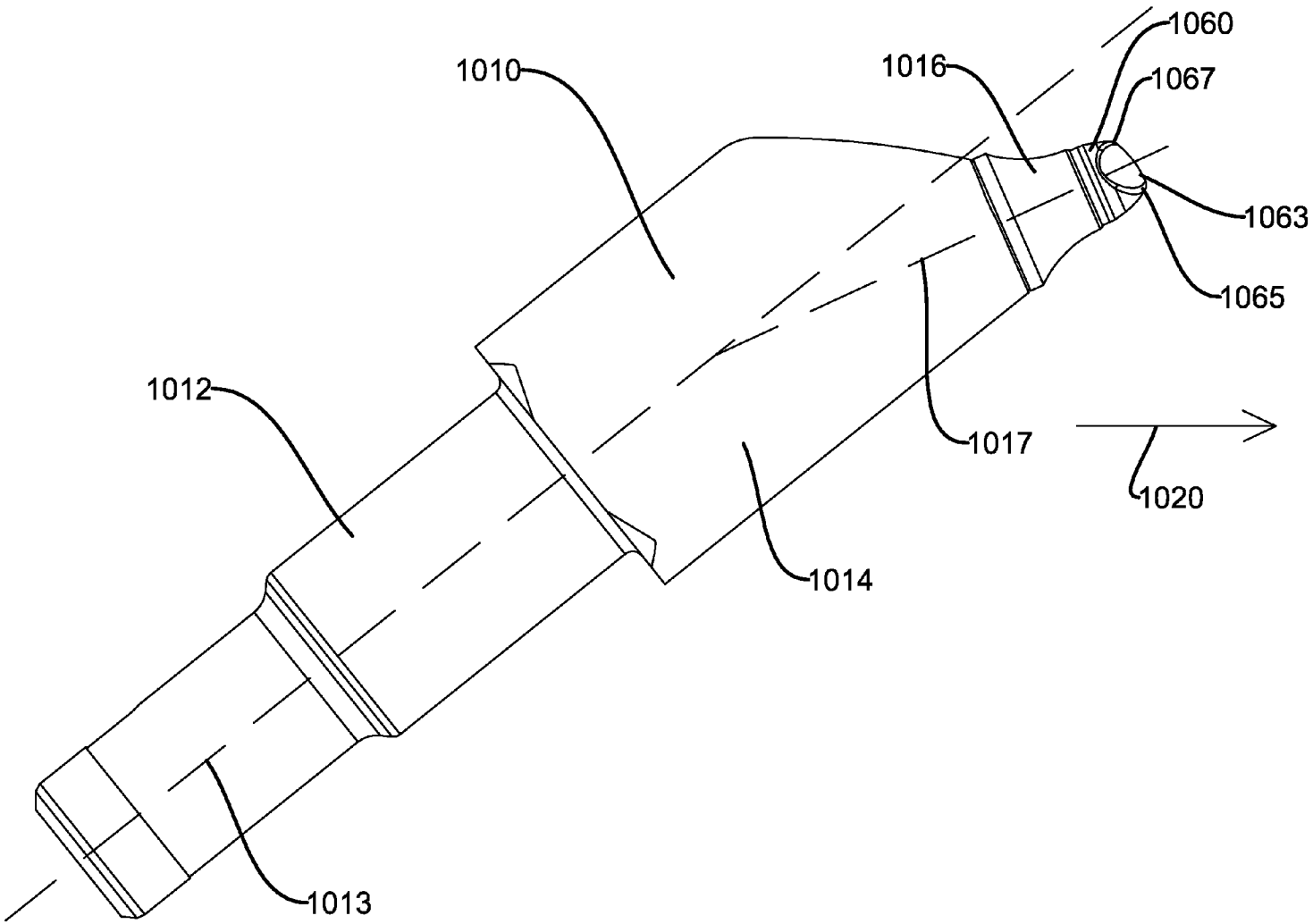
FIG. 10 is an orthogonal view of an embodiment of a degradation pick comprising a wedge shaped superhard material.

FIG. 10 shows an embodiment of a degradation pick 1010 comprising a hardened tip 1016, a body 1014 and a shaft 1012. The hardened tip 1016 may comprise a superhard material 1060 formed in a wedge shape with a ridge 1063 disposed at a distal end of the hardened tip 1016. An axis 1017 of the hardened tip 1016 may be offset from a central axis 1013 of the shaft 1012 such that a first end 1065 of the ridge 1063 extends beyond a remainder of the hardened tip 1016 in a direction of travel 1020 of the hardened tip 1016 when transported by a rotating drum or continuous chain. Also in this embodiment, the first end 1065 of the ridge 1063 of the wedge shape is disposed at a greater distance from the body 1014 than a second end 1067 of the ridge. As the shaft 1012 is rotationally positioned, the first end 1065 of the ridge 1063 may face the direction of travel 1020 of the hardened tip 1016.

Figure 11A:
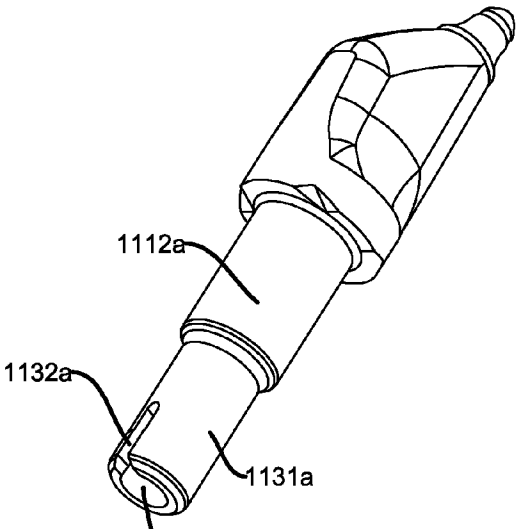
FIGS. 11*a* through 11*h* are various views of embodiments of locking mechanisms for degradation pick shafts.
Figure 11B:
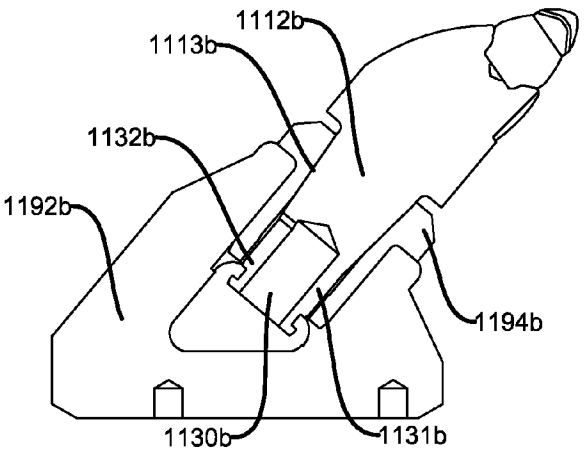
Figure 11C:
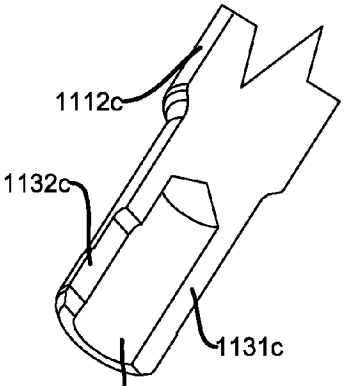

It may be desirable to secure degradation picks such as those described herein to resist rotation or axial displacement during violent use often encountered in road milling, mining, and trenching. FIGS. 11*a* through 11*h* show various embodiments of locking mechanisms for degradation pick shafts that may act to secure such shafts within a bore. For example, FIGS. 11*a* through 11*c* show embodiments of a degradation pick shaft 1112*a*, 1112*b*, 1112*c* comprising a hollow axial bore 1130*a*, 1130*b*, 1130*c* protruding into an end thereof. A side wall 1131*a*, 1131*b*, 1131*c* of the shaft 1112*a*, 1112*b*, 1112*c* surrounding the bore 1130*a*, 1130*b*, 1130*c* may comprise a slot 1132*a*, 1132*b*, 1132*c* disposed therein to provide compliancy to the bore 1130*a*, 1130*b*, 1130*c*. It is believed that the bore 1130*a*, 1130*b*, 1130*c* and slot 1132*a*, 1132*b*, 1132*c* combination may provide sufficient compliancy to resist rotation and axial displacement of the shaft 1112*a*, 1112*b*, 1112*c* while secured within a bore of a block 1192*b* or sleeve 1194*b* as the case may be. Additionally, the degradation pick shaft 1112*b* shown in the embodiment of FIG. 11*b* comprises a tapered section 1113*b* that may form a wedge within a bore of the block 1192*b* or sleeve 1194*b*. It is further believed that this wedge may resist rotation and axial displacement of the shaft 1112*b* while secured within a bore of the block 1192*b* or sleeve 1194*b*.

Figure 11D:
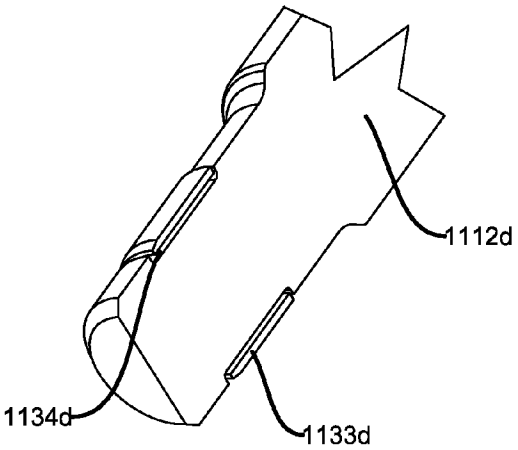

FIG. 11*d* shows an embodiment of a compliant ring 1133*d* disposed around a shaft 1112*d* of a degradation pick and axially secured within a recess 1134*d* of the shaft 1112*d*. As with the previous embodiment, it is believed that the compliant ring 1133*d* may provide sufficient compliancy to resist rotation and axial displacement of the shaft 1112*d* while secured within a bore of a block or sleeve as the case may be.

Figure 11F:
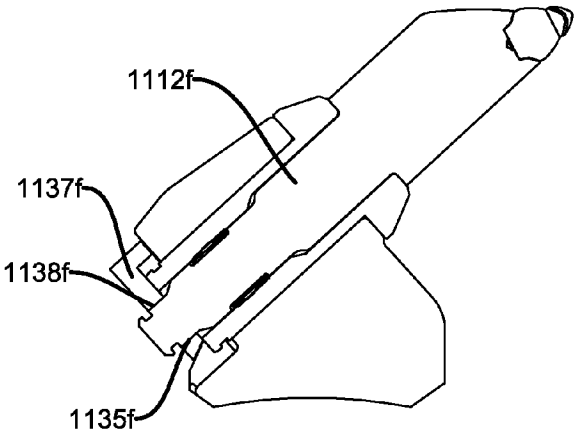
Figure 11H:
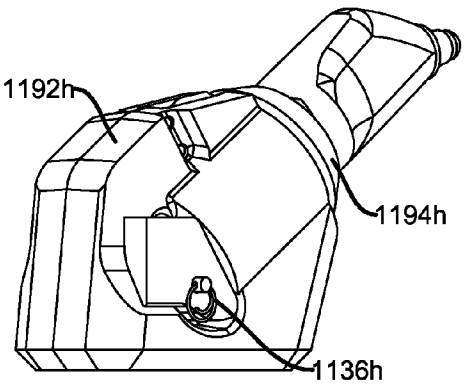
Figure 11E:
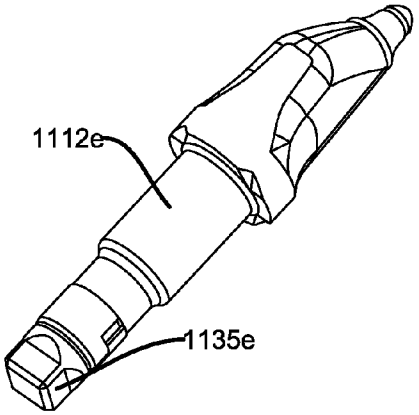

FIGS. 11*e* and 11*f* show embodiments of squared sections 1135*e*, 1135*f* of degradation pick shafts 1112*e*, 1112*f*. The squared sections 1135*e*, 1135*f* may fit within a complementary section within a block or sleeve to resist axial rotation of the shafts 1112*e*, 1112*f*. For example, the embodiment of FIG. 11*f* shows a fastener 1137*f* comprising a squared hole 1138*f* for receiving the squared section 1135*f* and preventing rotation of the degradation pick shank 1112*f*.

Figure 11G:
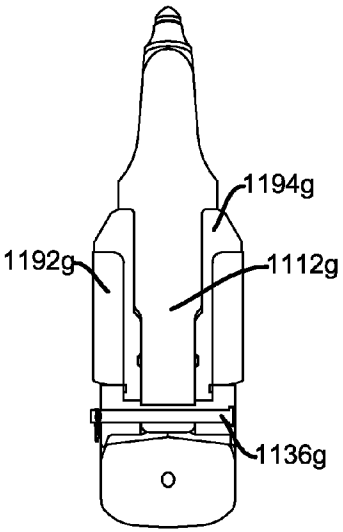

FIGS. 11*g* and 11*h* show embodiments of degradation pick shafts 1112*g* comprising pin connections. Such shafts 1112*g* may be secured within a block 1192*g*, 1192*h* or sleeve 1194*g*, 1194*h* by passing a pin 1136*g*, 1136*h* though mating holes within the blocks 1192*g*, 1192*h* and shafts 1112*g*.

While various embodiments of locking mechanisms are shown herein, it should be understood that any locking mechanism sufficient to resist rotation or axial displacement of a degradation pick shaft during violent use could be incorporated with the present invention.

Figure 12B:
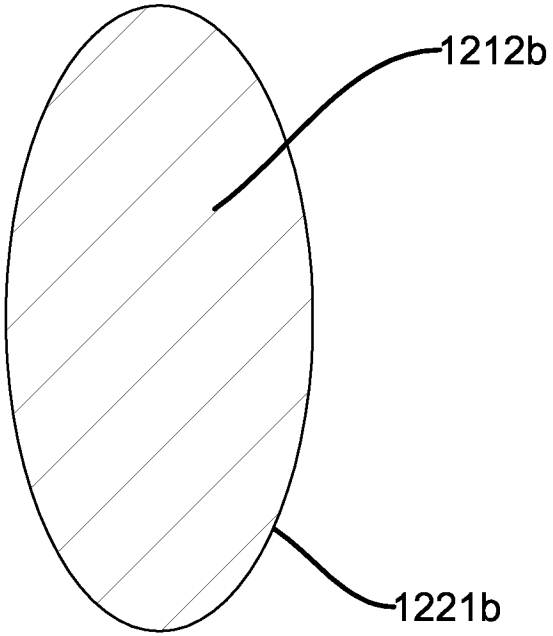
FIGS. 12*a* and 12*b* are cross-sectional views of embodiments of degradation pick shafts.
Figure 12A:
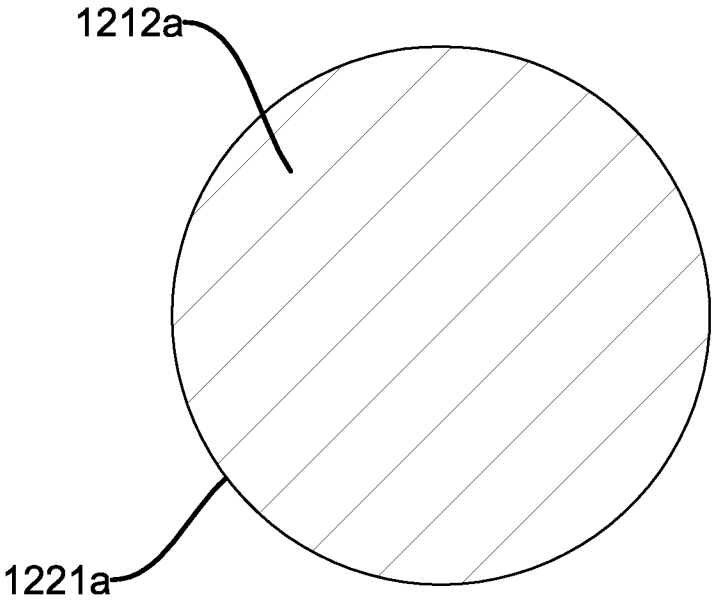

FIGS. 12*a* and 12*b* show embodiments of substantially cylindrical degradation pick shafts 1212*a*, 1212*b*. In various embodiments the substantially cylindrical shafts 1212*a*, 1212*b* may comprise a circular cross-sectional geometry 1221*a* or elliptical cross-sectional geometry 1221*b*. It may be appreciated that a shaft comprising a circular cross-sectional geometry may be inserted into a bore comprising a complementary circular cross-sectional geometry at a variety of rotational positions. This freedom of rotational positioning may be desirable to slant an axis of a hardened tip toward a direction of travel or position a protruding spine to push aggregate perpendicular to a plane of travel. However, if a locking mechanism were to fail, complementary circular cross-sectional geometries may also allow a shaft to rotate undesirably while in use. It may be also appreciated that a shaft comprising an elliptical cross-sectional geometry inserted into a bore comprising a complementary elliptical cross-sectional geometry may prevent rotational movement of the shaft even under the harshest of conditions.

Whereas the present invention has been described in particular relation to the drawings attached hereto, it should be understood that other and further modifications apart from those shown or suggested herein, may be made within the scope and spirit of the present invention.

What is claimed is:

1. A degradation device, comprising:

a rotatable element having a direction of rotation; and a degradation pick coupled to an exterior of the rotatable element, the degradation pick including:

a substantially cylindrical shaft including a central longitudinal axis;

a body attached to an end of the substantially cylindrical shaft; and a hardened tip attached to the body opposite the shaft, wherein the hardened tip is rotationally positioned such that a longitudinal axis of the hardened tip is slanted, in relation to the central longitudinal axis, in the direction of rotation, and wherein the body includes a protruding spine adjacent the hardened tip and opposite a direction of rotation of the hardened tip, an outer surface of the protruding spine being curved and substantially complementary to a curved path traveled by a distal end of the hardened tip when the rotatable element rotates in the direction of rotation, and an angle between the longitudinal axis of the hardened tip and the central longitudinal axis of the shaft is between 7 and 25 degrees.

2. The degradation device of claim 1, wherein the rotatable element is a rotatable drum or continuous chain.

3. The degradation device of claim 1, wherein the shaft is rotationally positioned such that the protruding spine pushes aggregate perpendicular to a plane in which the hardened tip travels.

4. The degradation device of claim 1, wherein an angle between the longitudinal axis of the hardened tip and the curved path traveled by the distal end of the hardened tip is between 25 and 43 degrees.

5. The degradation device of claim 1, wherein the shaft includes a locking mechanism to fix the shaft within a bore.

6. The degradation device of claim 5, the locking mechanism including a hollow axial bore protruding into an end of the shaft and a slot in a side wall of the shaft.

7. The degradation device of claim 5, the locking mechanism including a squared shaft section.

8. The degradation device of claim 1, wherein the hardened tip travels in a plane, and the body comprises a first dimension parallel to the plane and a second dimension perpendicular to the plane, and wherein the first dimension is larger than the second dimension.

9. The degradation device of claim 1, further comprising hard facing or hard materials secured to the body adjacent the hardened tip in a direction of rotation of the hardened tip.

10. The degradation device of claim 9, wherein the hard facing or hard materials wrap over a surface of the body facing the direction of rotation of the hardened tip.

11. The degradation device of claim 1, wherein the hardened tip has an aspect ratio between 0.86 and 1.

12. The degradation device of claim 1, wherein the hardened tip includes a superhard material having a substantially conical shape.

13. A degradation device, comprising:

a rotatable element having a direction of rotation; and a degradation pick coupled to an exterior of the rotatable element, the degradation pick including:

a substantially cylindrical shaft including a central longitudinal axis;

a body attached to an end of the substantially cylindrical shaft; and a hardened tip attached to the body opposite the shaft, wherein the hardened tip is rotationally positioned such that a longitudinal axis of the hardened tip is slanted, in relation to the central longitudinal axis, in the direction of rotation;

wherein the body includes a protruding spine adjacent the hardened tip and opposite a direction of rotation of the hardened tip, an outer surface of the protruding spine being curved and substantially complementary to a curved path traveled by a distal end of the hardened tip when the rotatable element rotates in the direction of rotation, and the hardened tip includes a superhard material including a wedge shape formed from two surfaces meeting at a ridge at the distal end of the hardened tip, wherein an angle at the ridge formed by the two surfaces is wider at a first end than at a second end.

14. The degradation device of claim 13, wherein the shaft is rotationally positioned such that the ridge of the wedge shape is parallel to a plane in which the hardened tip travels.

15. The degradation device of claim 13, wherein the axis of the hardened tip is offset from the central axis of the shaft such that one end of the ridge extends beyond a remainder of the hardened tip in a direction of travel of the hardened tip.

16. The degradation device of claim 13, wherein the first end of the ridge of the wedge shape is located at a greater distance from the body than the second end of the ridge.

17. The degradation device of claim 16, wherein the shaft is rotationally positioned such that the first end of the ridge is facing the direction of rotation of the hardened tip.

18. A degradation device, comprising:

a rotatable element having a direction of rotation; and a degradation pick coupled to an exterior of the rotatable element, the degradation pick including:

a substantially cylindrical shaft including a central longitudinal axis, the substantially cylindrical shaft including an elliptical cross-sectional geometry;

a body attached to an end of the substantially cylindrical shaft; and a hardened tip attached to the body opposite the shaft, wherein the hardened tip is rotationally positioned such that a longitudinal axis of the hardened tip is slanted, in relation to the central longitudinal axis, in the direction of rotation, and wherein the body includes a protruding spine adjacent the hardened tip and opposite a direction of rotation of the hardened tip, an outer surface of the protruding spine being curved and substantially complementary to a curved path traveled by a distal end of the hardened tip when the rotatable element rotates in the direction of rotation.

19. The degradation device of claim 18, further comprising:

a locking mechanism, the elliptical cross-sectional geometry rotationally locking the degradation pick.

20. The degradation device of claim 19, the locking mechanism including:

a compliant ring around the shaft;

a squared shaft section; or a pin connection including a pin and mating pin hole within the shaft.

* * * * *